United States Patent [19]

Watson

[11] 4,190,524

[45] Feb. 26, 1980

[54] MAGNETIC SEPARATORS

[75] Inventor: James H. P. Watson, St. Austell, England

[73] Assignee: English Clays Lovering Pochin & Co., Ltd., Cornwall, England

[21] Appl. No.: 597,686

[22] Filed: Jul. 21, 1975

[30] Foreign Application Priority Data

Jul. 19, 1974 [GB] United Kingdom ..... 32216/74

[51] Int. Cl.[2] ..... B03C 1/02

[52] U.S. Cl. ..... 209/213; 209/232; 210/222

[58] Field of Search ..... 209/223, 213, 214, 232, 209/218, 216; 210/222, 223; 55/3, 100

[56] References Cited

U.S. PATENT DOCUMENTS

| | | | |
|---|---|---|---|
| 2,951,586 | 9/1960 | Moriya | 210/223 |
| 2,993,601 | 7/1961 | Moriya | 210/223 |
| 3,567,026 | 3/1971 | Kolm | 210/222 |
| 3,627,678 | 12/1971 | Marston | 210/222 X |
| 3,912,634 | 10/1975 | Howell | 210/222 |

FOREIGN PATENT DOCUMENTS

| | | | |
|---|---|---|---|
| 691388 | 5/1953 | United Kingdom | 210/223 |
| 1300309 | 12/1972 | United Kingdom | 210/223 |

*Primary Examiner*—Robert Halper

*Attorney, Agent, or Firm*—Armstrong, Nikaido, Marmelstein & Kubovcik

[57] ABSTRACT

A magnetic separator, for separating magnetizable particles from a fluid, consists of a separating chamber filled with a paramagnetic packing material, and a magnet for establishing a magnetic field within the packing material. The packing material is pervious to the fluid. A process for separating magnetizable particles from a fluid consists in applying a magnetic field to the packing material while passing the fluid therethrough, so as to attract the magnetizable particles in the fluid to collecting sites within the packing material.

2 Claims, 4 Drawing Figures

MAGNETIC SEPARATORS

BACKGROUND OF THE INVENTION

This invention relates to magnetic separators and, more particularly, is concerned with materials for packing the interior of a separating chamber which in use is placed in a high-intensity magnetic field and which forms part of a magnetic separator for separating magnetisable particles from a fluid in which they are suspended. The invention is also concerned with a process for separating magnetisable particles from a fluid in which they are suspended.

The force exerted on a spherical particle of magnetisable material in a magnetic field is given by the formula:

$$F=X_m(\pi D^3/6)\ H(\delta H/\delta x)$$

where $X_m$ is the volume magnetic susceptibility of the material, D is the diameter of the particle, H is the magnetic field intensity and $\delta H/\delta x$ is the rate of change of the magnetic field intensity with distance.

Heretofore the separating chamber has been packed with ferromagnetic material, usually having a particulate or filamentary nature, to provide within the separating chamber a large number of points or collecting sites at which the local magnetic field intensity is high, interspersed with points of low local magnetic field intensity. This arrangement provides within the separating chamber a magnetic field which changes rapidly with distance and, as can be seen from the above expression, a high magnetic field gradient gives rise to a large force on a magnetisable particle. A very non-homogeneous magnetic field is especially desirable for separating magnetisable particles which have low magnetic susceptibilities and/or small diameters. Examples of suitable packings are:

(a) filamentary ferromagnetic materials, such as steel wool, or (b) particulate ferromagnetic materials such as spheres, cylindrical pellets or cubes of ferromagnetic materials or more irregular particles such as those which are obtained when a block of ferromagnetic material is subjected to the action of a milling machine, or (c) a foam of ferromagnetic material.

Heretofore, the fluid containing the magnetisable particles to be separated has been passed through the separating chamber containing the ferromagnetic packing material, and, at the same time, a magnetic field has been applied to the material, so that the packing material has been magnetised and the magnetisable particles attracted to the collecting sites within the packing material. The field has then been reduced to zero, preferably by alternating the field and progressively reducing its amplitude so as to take the value of the magnetisation of the packing material around a smaller and smaller hysteresis loop, until the residual magnetism within the packing material is effectively reduced to zero. A clean fluid has then preferably been flushed through the packing material to remove the magnetisable particles which have been collected. However, some of the magnetisable particles tend to form closed magnetic loops within the packing material when under the influence of the applied magnetic field, and these loops are not generally broken by the above-described degaussing process. Thus some of the particles may still be attracted to the packing material after the field has been reduced to zero, and may not therefore be removed by flushing out the separating chamber with a clean fluid.

For example, if a suspension of particulate solid material containing ferromagnetic particles, such as, for example, fine iron filings or particles of ferromagnetic iron compounds, such as magnetite, haematite or pyrrhotite, is passed through the separating chamber, it may be extremely difficult, if not impossible, to remove these ferromagnetic particles from the collecting sites within the packing material to which they are attracted, when the magnetic field is reduced to zero. Thus a proportion of the collecting sites, previously available for the collection of magnetisable particles, will remain occupied when a suspension of particulate solid material is next passed through the separator, and the efficiency of the magnetic separation process is reduced. If this retention of magnetic particles at the collecting sites is allowed to continue the packing may eventually become almost completely blocked.

SUMMARY OF THE INVENTION

According to the first aspect of the invention, there is provided, in a magnetic separator for separating magnetisable particles from a fluid having such particles in suspension therein, the separator comprising a separating chamber having an inlet and an outlet for a fluid, a packing material which is pervious to the fluid disposed within the separating chamber between the inlet and the outlet, and means for establishing a magnetic field in the region of the packing material within the separating chamber, the improvement which comprises the packing material being paramagnetic at normal operating temperatures and normal operating magnetic field intensities.

The separating chamber may additionally be provided with a packing material, which is pervious to the fluid and which is ferromagnetic at normal operating temperatures and normal operating magnetic field intensities, disposed between the paramagnetic packing material and the outlet.

The magnetic separator may also be provided with a further separating chamber comprising an inlet and an outlet for a fluid, and, disposed between the inlet and the outlet, a packing material which is pervious to the fluid and which is ferromagnetic at normal operating temperatures and normal operating magnetic field intensities, the further separating chamber being disposed downstream of the separating chamber containing the paramagnetic packing material.

The main advantage of a separating chamber containing a paramagnetic packing material, as opposed to a ferromagnetic packing material, is that it provides a method of collecting very fine ferromagnetic particles from suspension in a fluid in such a way that the particles can subsequently be easily removed from the collecting sites, since the bond formed between a paramagnetic packing material and a ferromagnetic particle is such that the ferromagnetic particle is released as soon as the packing material is isolated from the field. A further advantage is that the attractive force between a ferromagnetic particle and a paramagnetic packing material in a magnetic field increases proportionally as the intensity of the magnetic field is increased. In the case of a ferromagnetic particle being attracted to a ferromagnetic packing, on the other hand, there is a field intensity at which the particle and packing become magnetically saturated and a further increase in field intensity will not increase the attractive force between the particle and the packing. Although the attractive force obtainable between the particle and the packing is higher in the ferromagnetic packing/ferromagnetic particle case, in the paramagnetic packing/ferromagnetic particle case more control is exercisable over the attractive force by varying the field intensity, and it is therefore easier to classify particles precisely according to their magnetic susceptibilities.

Paramagnetism occurs in materials when the individual atoms, ions, or molecules of the material possess a permanent magnetic dipole. In the absence of a magnetic field, these dipoles point in random directions and there is no resultant magnetisation of the material as a whole in any direction. However, when an external field is applied to the material, the dipoles tend to orient themselves parallel to the field, thus giving a net magnetisation parallel to the field and a positive value to the susceptibility $\chi$ of the material (as opposed to the negative value obtained for a diamagnetic material). The interactions between individual atoms, ions or molecules in a paramagnetic material are negligible. At normal operating temperatures (usually but not necessarily ambient temperatures) and normal operating magnetic field intensities (i.e. $10^4$ to $10^5$ Gauss) paramagnetic materials have magnetic permeabilities $\mu$ slightly greater than 1 (i.e. volume magnetic susceptibilities $\chi$ slightly greater than zero), whereas ferromagnetic materials have magnetic permeabilities of the order of $10^4$. The condition which must be satisfied by the field intensity H ad the temperature T of a paramagnetic material in order that its susceptibility should vary linearly with field intensity is:

$$\bar{m}H/kT << 1$$

where $\bar{m}$ is the average magnetic moment per atom of the material, and k is Boltzmann's constant. Therefore at ambient operating temperatures the field intensity may reach a value of $10^6$ Gauss before the normal paramagnetic behaviour of the material breaks down. A more extensive definition of a paramagnetic material is provided in the book "The Handbook of Physics", Condon, E. U. and Odishaw, H. (Eds.) 1958, at pages 4–127 et seq, and in the book "Electricity and Magnetism", Bleaney, B. I. and Bleaney, B., second edition.

Paramagnetic materials suitable for use in the present invention include, for example, aluminium, titanium, vanadium, chromium, manganese, molybdenum, palladium and platinum and certain paramagnetic alloys such as austenitic stainless steel, cupro-nickel and copper-manganese. With most of the paramagnetic materials in this list, changing the temperature in the packing material within the range of, say, 0° to 100° C. will have relatively little effect on the attractive force between a ferromagnetic particle and the paramagnetic packing material since their Curie points are well outside this temperature range. The most important effect of temperature change with these materials will be upon the viscosity of the fluid in which the particles are suspended and hence the velocity with which the particles move through the fluid. Certain magnetic materials, however, have a Curie point at or around room temperature; of these some are exotic and expensive, such as gadolinium which has a Curie point of 16° C., and some are alloys whose mechanical properties may make them unsuitable for use as packing materials; but one type of alloy having a Curie point which may be within the range of 0° to 100° C. and which may be useful is the cupro-nickel type. At a copper content of 35% by weight, cupro-nickel has a Curie point of 16° C., and, at a copper content of 40%, a Curie point of 33° C. Using alloys of this type, a very different effect on the attractive force between a ferromagnetic particle and the packing material may be achieved using the same alloy by utilizing a different operating temperature and/or composition of the copper-nickel alloy.

The paramagnetic material may be particulate or filamentary or in the form of a magnetisable foam.

When the material is particulate, it may be in the form of pellets of substantially spherical, cylindrical or cubic shape or of a more irregular form, such as, for example, that obtained when a block of material is subjected to the action of a milling machine. If the magnetisable particles to be separated have an equivalent spherical diameter of about 10 $\mu$m, the largest dimension of the particles of paramagnetic material is preferably in the range from 100 to 2000 $\mu$m. If the packing material is particulate, the density of the packing is generally such that, of the total volume of the chamber occupied by the packing, from 25% to 95% and preferably from 30% to 70%, is void. If the largest dimension of a particle of packing material is much less than 100 $\mu$m for this preferred packing density, the flow channels through the packing material become too small and the flow rate of the fluid containing the magnetisable particles is impeded to an undesirable degree. If the largest dimension of a particle of packing material is much larger than 2000 $\mu$m, the material tends not to capture the very fine magnetisable particles from the fluid, since the field within the material then does not change sufficiently rapidly with distance.

Alternatively, the packing may be in filamentary form, such as, for example, in the form of a fine wire mesh, an expanded metal mat or a metallic wool, or it may be in the form of metallic foam. The filaments are advantageously ribbon-shaped. When the material is filamentary, if the magnetisable particles to be separated have an equivalent spherical diameter of about 10 $\mu$m, the largest cross-sectional dimension of the filaments is preferably in the range from 25 to 250 $\mu$m. In each of these cases the density of the packing would generally be such that, of the total volume of the chamber occupied by the packing, from 60% to 98%, and preferably from 75% to 97%, is void.

When the packing material is constituted by particles or filaments of small diameter, the particles or filaments are closely packed together and yet leave sufficient void volume to permit the fluid containing the particles to be separated (which fluid is hereinafter called the slurry) to flow through the packing material at an acceptable rate. If a packing material of uniform density is provided to meet these conditions, the problem arises that most of the magnetisable particles are extracted from the slurry in the upstream part of the packing, i.e. in the region of the packing adjacent the inlet of the chamber, with the result that the flow of the slurry through the packing is impeded and the regions of the packing downstream are inefficiently used.

If N(in) is the number of magnetisable particles in the incoming slurry and N(out) is the number of magnetisable particles in the outgoing slurry, and if the flow of slurry is considered to be streamline and the voidage of the packing is greater than a certain critical low value, the efficiency of extraction of the magnetisable particles from the slurry is given by the following expression:

$$N(\text{out}) = N(\text{in}) \exp. (-F\alpha L)$$

where F is the packing density of the packing material, L is the length of the packing traversed by the slurry, and $\alpha$ is a parameter of the packing material which is approximately inversely proportional to the diameter of the particles or filaments constituting the material. Therefore, in the cases in which the packing material is particulate or filamentary in form, and particularly in the latter case, it is sometimes advantageous to (a) increase the packing density of the packing material from the region of the chamber adjacent the inlet to the region of the chamber adjacent the outlet; and/or (b) decrease the diameter of the filaments or particles of the packing material from the region adjacent the inlet to the region adjacent the outlet.

Alternative (a) given above has the effect of making F in the above expression greater at the downstream region of the packing material than at the upstream region and may be achieved, for example, by utilizing greater pressure to compact the packing material at the downstream region and progressively less pressure at the regions further upstream. The efficiency of collection of magnetisable particles by a material of uniform packing density is shown by the expression to be greater in the downstream region than in the upstream region, and therefore, by suitably adjusting the packing density F, it is possible to provide a packing material which fills with collected magnetisable particles equally throughout its length.

Alternative (b) has the effect of making the parameter $\alpha$ in the expression greater in the downstream region of the packing material than in the upstream region and thus may be used to achieve a similar result to alternative (a). It may be effected simply by providing fine particles or filaments at the downstream region and progressively coarser sizes at the regions further upstream. By way of example, a packing of the required type may be provided by packing the downstream end of the separating chamber with a layer of stainless steel wool of very fine filament diameter and then packing layers of progressively coarser grades of stainless steel wool towards the upstream regions. Alternatively, the separating chamber may be packed with discs cut from woven meshes of paramagnetic filamentary material or from sheets of expanded paramagnetic metal, the discs being of small aperture size near the downstream end of the separating chamber and of progressively larger aperture size towards the upstream end.

The means for establishing the magnetic field may be a conventional electromagnet coil or a superconducting electromagnet coil. However, if magnetic field intensities above approximately $2.10^4$ Gauss are required, then a superconducting electromagnet coil should generally be used.

Even in a high intensity magnetic separator utilizing a superconducting electromagnet coil, the temperature in the packing material will be at or near the ambient temperature. The thermal insulation of the cryostat required for surrounding the superconducting electromagnet coil is generally so good that there is little transmission of heat through the walls. Furthermore the high intensity magnetic field generates only a very small heating effect in the packing material. Some heating may be caused by eddy currents within the packing material but the particulate, filamentary or porous nature of the packing material generally renders the effect so small as to be negligible.

According to a second aspect of the present invention, there is provided a process for separating ferromagnetic particles from a fluid having such particles in suspension therein, which process comprises:

passing the fluid through a separating chamber containing a packing material which is paramagnetic at normal operating temperatures and normal operating magnetic field intensities and which is pervious to the fluid, and, at the same time, subjecting the packing material within the chamber to a magnetic field.

The process may comprise the further step of passing clean fluid through the packing material, having isolated the packing material from the magnetic field, to remove any ferromagnetic particles which have been retained by the material.

In a development of the process of the invention, a mixture of paramagnetic and ferromagnetic particles are separated from a fluid having such particles in suspension therein, by carrying out the above-described process, either with or without said additional step, and then passing the fluid through a further separating chamber containing a packing material which is ferromagnetic at normal operating temperatures and normal operating magnetic field intensities and which is pervious to the fluid, and, at the same time, subjecting the packing material within the further chamber to a magnetic field.

If the fluid contains non-magnetisable particles (or particles which may be magnetised only very weakly), in addition to the magnetisable particles in suspension therein, the magnetisable particles may be separated from the non-magnetisable particles by passing the fluid through the packing material and then, after having isolated the packing material from the magnetic field, removing the magnetisable particles therefrom by flushing with a fluid.

BRIEF DESCRIPTION OF THE DRAWINGS

For a better understanding of the present invention and to show how the same may be carried into effect, reference will now be made, by way of example, to the accompanying drawings, in which.

DETAILED DESCRIPTION OF THE DRAWINGS

Figure 1:
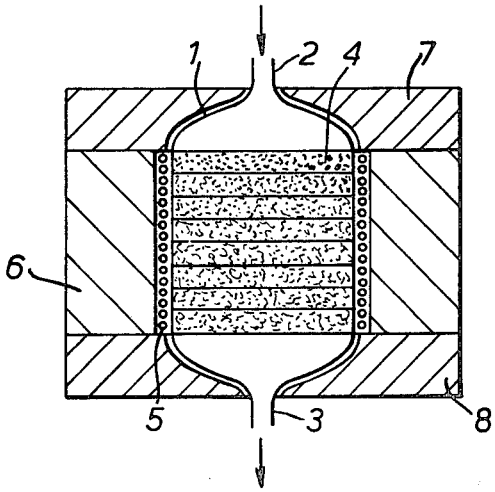
FIG. 1 shows, in diagrammatic manner, a vertical section of a first embodiment of apparatus of the invention.

FIG. 1 shows a separating chamber 1, made of non-magnetisable material, which is provided with an inlet aperture 2 and an outlet aperture 3 for a feed fluid containing ferromagnetic particles in suspension therein. (The direction of flow of the feed fluid can be reversed so that aperture 2 becomes an outlet and aperture 3 an inlet.) The chamber 1 is packed with a plurality of expanded aluminium discs 4, aluminium being a suitable paramagnetic material at normal operating temperatures and normal operating magnetic field intensities. An electromagnet coil 5 of a superconducting magnet surrounds the chamber 1 and is accommodated in a recess in a ferromagnetic return frame which comprises an inner member 6, a top member 7 and a bottom member 8. The top member 7 is removable to give access to the vessel and packing. The magnetic field intensity in operation of such apparatus may be of the order of $5.10^4$ Gauss.

An apparatus substantially as described above may be used, for example, in a process which comprises the following steps:

(a) passing a suspension containing a mixture of particulate solid materials having different magnetic susceptibilities through the packing material in the separating chamber while a high-intensity magnetic field, e.g. $10^4$ to $10^5$ Gauss, is maintained in the region of the separating chamber;

(b) stopping the flow of suspension when the collecting sites in the packing have become substantially completely filled with ferromagnetic particles (i.e. when the proportion of magnetisable particles in the suspension leaving the separating chamber rises above an acceptable level);

(c) passing a stream of clean fluid through the separating chamber in the same direction and at approximately the same velocity as the suspension to remove physically entrained and loosely held magnetisable particles from the packing, while the high-intensity magnetic field is maintained in the region of the separating chamber;

(d) isolating the packing from the magnetic field and optionally subjecting the captured ferromagnetic particles to an alternating magnetic field which is gradually reduced to zero; and (e) flushing the packing with a stream of clean liquid or air under pressure, and preferably flowing in a direction opposite to that of the suspension, to remove ferromagnetic particles from the packing.

The advantages of the above-described apparatus become apparent principally in the step of isolating the packing from the magnetic field, since the ferromagnetic packings which have been conventionally used in the past may retain some magnetisable particles even after the magnetic field in the region of the separating chamber is reduced to zero (as has already been described). However, when the packing is of a paramagnetic material, the ferromagnetic particles may be flushed out of the packing relatively easily.

Figure 2:
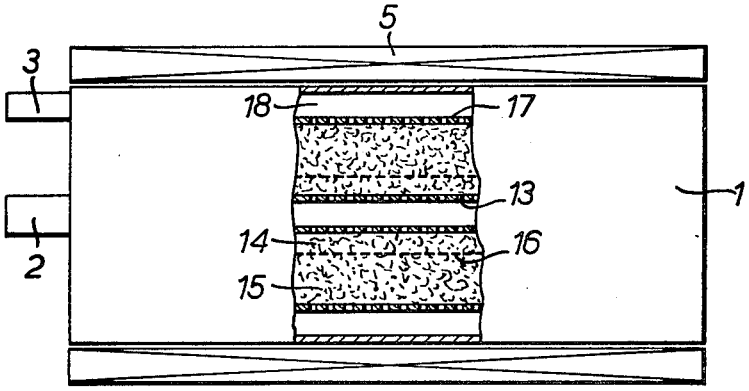
FIG. 2 shows a side elevation, partly in section, of a second embodiment of apparatus of the invention.
Figure 3:
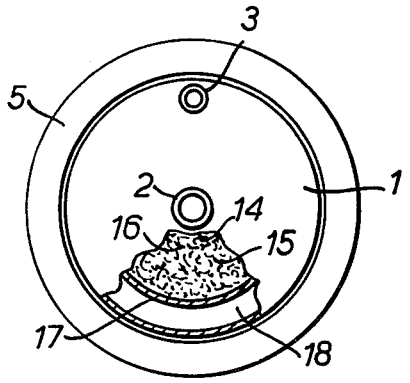
FIG. 3 shows an end elevation, partly cut away, of the apparatus of FIG. 2.

Referring to the apparatus of FIGS. 2 and 3, a cylindrical separating chamber 1, made of non-magnetisable material, is provided with an inlet 2 which communicates with an axial foraminous tube 13. Surrounding the tube 13 is a layer of austenitic stainless steel wool 14, austenitic stainless steel being a suitable paramagnetic material and generally consisting of flattened or ribbon-shaped filaments. The filaments in this case should have their largest cross-sectional dimension in the range from 25 to 250 μm. An annular layer 15 of ferritic stainless steel wool or "stainless iron" wool surrounds the austenitic stainless steel wool, the two parts of the packing being separated by a tube of phosphor bronze wire mesh 16. Surrounding the layer 15 of ferritic stainless steel wool is a further foraminous tube 17 which leads to an annular cavity 18. An outlet 3 to the separating chamber communicates with the annular cavity 18. The separating chamber 1 is fitted within the bore of a high-intensity electromagnet coil 5 of a superconducting magnet.

When a slurry containing a mixture of ferromagnetic and paramagnetic particles enters the packing through inlet 2 and the apertures in the foraminuous tube 13, it flows radially outwards firstly through the paramagnetic packing and then through the ferromagnetic packing. The slurry then passes through the foraminuous tube 17 to the annular cavity 18 from which it leaves by the outlet 3. Under the action of a magnetic field applied by the coil 5, the ferromagnetic particles in the slurry are attracted to collecting sites in the layer of austenitic stainless steel wool 14 and the paramagnetic particles are attracted to collecting sites in the layer of ferritic stainless steel wool 15. The liquid and any non-magnetic or very weakly magnetic particles pass right through the packing and emerge from the outlet 3.

When the collecting sites in one or both of the layers of packing material are substantially filled with collected particles, the flow of feed slurry is stopped and, with the field still applied, the packing material is flushed out with clean liquid, flowing at approximately the same rate and in the same direction as the feed slurry, in order to wash the packing material clean of feed slurry and any physically entrained non-magnetic particles. The separating chamber 1 is then removed from the zone of influence of the electromagnet coil 5 and brought within the zone of influence of a second coil (not shown) which provides an alternating magnetic field, the amplitude of which is gradually reduced to zero. At the same time the packing material is flushed out with a stream of clean liquid at high velocity and at high pressure, in the same direction as the feed slurry, to remove the ferromagnetic and paramagnetic particles collected by the packing material.

The feed slurry may be, for example, an aqueous suspension of an impure kaolinitic clay which may contain, for example, ferromagnetic impurities, such as very fine particles of iron, and paramagnetic particles, such as iron oxides, iron-stained quartz and mica which may contain small amounts of iron in its crystal lattice. Kaolinite itself has such a small magnetic susceptibility as to be virtually unmagnetisable. The ratio of the thickness of the layer 14 of paramagnetic packing material to that of layer 15 of ferromagnetic material depends on the ratio of ferromagnetic impurities to paramagnetic impurities. The proportion of ferromagnetic particles in a kaolinitic clay suspension is very small and the thickness of the layer of the paramagnetic packing material need only be of the order of one fifth to one third of the thickness of the layer of ferromagnetic material in apparatus for separating the magnetisable particles from such a clay suspension.

Figure 4:
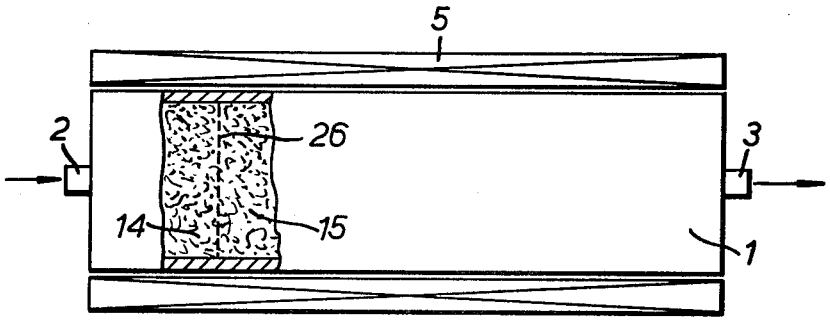
FIG. 4 shows a side elevation, partly in section, of a third embodiment of apparatus of the invention.

Referring to the apparatus of FIG. 4, a separating chamber 1 made of non-magnetisable material, is provided with an inlet 2 and outlet 3. The separating chamber contains a layer of austenitic stainless steel wool 14 adjacent the inlet 2 and a layer of ferritic stainless steel wool 15 adjacent the outlet 3. The two types of steel wool are separated by a partition 26 made of phosphor-bronze wire mesh. The separating chamber 1 is fitted within the bore of a high intensity electromagnet coil 5 of a superconducting magnet. The operation of this apparatus is similar to that of the apparatus described with reference to FIGS. 2 and 3, except that the slurry will flow axially through the separating chamber instead of radially as in the latter apparatus.

EXAMPLE

An example of the use of the device described with reference to FIG. 1 would be to remove fine ferromagnetic particles from a dilute suspension of such particles in a fluid. By "dilute suspension" is meant a suspension containing an amount of such particles representing not more than about 10% by weight of the total weight of suspension, and as little as a few parts per million of the particles or of the order of about 0.0005% by weight of the suspension. By "fine" particles is meant particles having an equivalent spherical diameter less than about 10 μm. Dilute suspensions of such particles are notoriously difficult to clarify because the particles, being so widely dispersed, take a considerable time to come together to form flocs or agglomerates of sufficient size to sink at an appreciable rate to the bottom of a vessel in which the fluid is contained. Similarly the suspensions are difficult to filter by conventional means because the particles tend to pass through the pores of conventional filter media unless they are first brought together to form flocs or agglomerates.

A dilute suspension of fine ferromagnetic particles in a fluid may be clarified in a process which comprises the following steps:

(a) passing a dilute suspension containing fine ferromagnetic particles through a paramagnetic packing in a separating chamber while a high-intensity magnetic field is maintained in the region of the separating chamber in order that the fine ferromagnetic particles are attracted to the packing and caused to adhere thereto and to each other to form clusters;

(b) stopping the flow of suspension when the collecting sites in the packing have become substantially completely filled with ferromagnetic particles;

(c) isolating the packing from the magnetic field or de-energising the electromagnet which generates the magnetic field;

(d) flushing the packing with a stream of clean fluid under pressure to remove the clusters of ferromagnetic particles from the packing; and (e) passing the resultant suspension of clusters of ferromagnetic particles in the flushing fluid through a conventional filter to separate the ferromagnetic particles from the fluid.

After step (c) and during step (d) the captured ferromagnetic particles may be subjected to an alternating magnetic field which is gradually reduced to zero.

Preferably the suspension of clusters of ferromagnetic particles produced in step (d) is not subjected to any shearing action prior to the filtration step as this would tend to break down the clusters into individual fine particles which would be difficult to retain on a filter medium.

This process works by collecting the dispersed ferromagnetic particles on collecting sites in the packing where, as the feed suspension is passed continuously through the packing, other ferromagnetic particles are attracted to them and clusters are formed. When the magnetic field is reduced sufficiently, the attraction of one ferromagnetic particle for another is greater than the attraction of the cluster of particles for the paramagnetic packing and the cluster can easily be removed from the packing by a stream of fluid.

It was required to remove, from suspension in a light machine oil having a viscosity at 20° C. of about 1 poise, fine nickel particles having a spiky, roughly spherical shape and diameters in the range from about 3 μm to about 7 μm, the concentration of the nickel powder in the oil being about 1% by volume or about 10% by weight. The suspension was passed in samples of 300 ml at varying rates of flow through a cylindrical separating chamber of internal diameter 35 mm which was packed with fifty-four discs cut from an expanded aluminium sheet having lozenge-shaped apertures of approximately 1.5 mm×2 mm. The percentage volume of voidage in the packing was 80% so that the mean cross-sectional area of voids, or the average total area of flow channels available in a given cross-section, was 7.7 $cm^2$. The separating chamber was positioned between the pole pieces of an electromagnet which generated a field of about 7,000 Gauss in the packing.

The efficiency of extraction of the nickel particles from the oil was estimated by filtering the suspension emerging from the separating chamber on a Buchner funnel, washing the residue with trichloroethylene to remove the oil, and drying and weighing the nickel powder. The amount of nickel remaining in suspension in the oil after treatment in the magnetic field was expressed as a percentage by weight of the original nickel content. The results are set forth in the following table:

TABLE

| Flow rate of suspension | | % by wt. of nickel |
|---|---|---|
| ml/sec. | cm/min. | remaining in suspension |
| 6.2 | 47.3 | 1.65 |
| 8.45 | 65.9 | 7.0 |
| 8.95 | 69.8 | 9.2 |
| 11.05 | 86.2 | 11.9 |

Nickel particles finer than those described above, e.g. having particle diameters of the order of 1–2 μm, could be removed from suspension in a liquid using the above described device, but with increased field strength and/or a packing having a smaller filament or particle diameter. More preferably a packing is used which has a relatively coarse particle or filament diameter at the upstream end of the separating chamber and becomes progressively finer towards the downstream end.

A further application of the invention is in a process for removing heavy metal ions from an industrial effluent. The heavy metal ions are chemically precipitated as their ferrites which are ferromagnetic and can therefore be removed using the apparatus and general method described above. For example, an aqueous suspension containing of the order of 20–100 ppm of heavy metal ferrites can be rendered substantially free of the heavy metal contaminants and therefore suitable for discharge to a river or stream.

What I claim is:

1. In a magnetic separator for separating magnetizable particles from a fluid having such particles in suspension therein, the separator comprising a separating chamber having an inlet and an outlet for a fluid, a packing material which is pervious to the fluid disposed within the separating chamber between the inlet and the outlet, and electromagnetic means for establishing a magnetic field in the region of the packing material within the separating chamber, the improvement which comprises the packing material being paramagnetic at normal operating temperatures and normal operating magnetic field intensities, said chamber additionally being provided with a packing material, which is pervious to the fluid and which is ferromagnetic at normal operating temperatures and normal operating magnetic field intensities, disposed between the paramagnetic packing material and the outlet.

2. In a separator for separating magnetizable particles from a fluid having such particles in suspension therein, the separator comprising a separating chamber having an inlet and an outlet for a fluid, a packing material which is pervious to the fluid disposed within the separating chamber between the inlet and the outlet, and electromagnetic means for establishing a magnetic field in the region of the packing material within the separating chamber, the improvement which comprises the packing material being paramagnetic at normal operating temperatures and normal magnetic field intensities, and a further separating chamber being provided, the further separating chamber comprising an inlet and an outlet for a fluid and, disposed between the inlet and the outlet, a packing material which is pervious to the fluid and which is ferromagnetic at normal operating temperatures and normal operating magnetic field intensities, the further separating chamber being disposed downstream of the separating chamber containing the paramagnetic packing material.

* * * * *